US010508486B2

(12) United States Patent
Schwerdt et al.

(10) Patent No.: US 10,508,486 B2
(45) Date of Patent: Dec. 17, 2019

(54) GLASS-FIBER-REINFORCED SPACER FOR INSULATING GLAZING UNIT

(71) Applicant: SAINT-GOBAIN GLASS FRANCE, Courbevoie (FR)

(72) Inventors: Egbert Schwerdt, Berg (CH); Walter Schreiber, Aachen (DE); Martin Rigaud, Pfungen (CH)

(73) Assignee: SAINT GOBAIN GLASS FRANCE, Courbevoie (FR)

( * ) Notice: Subject to any disclaimer, the term of this patent is extended or adjusted under 35 U.S.C. 154(b) by 60 days.

(21) Appl. No.: 15/554,418

(22) PCT Filed: Feb. 29, 2016

(86) PCT No.: PCT/EP2016/054226
§ 371 (c)(1),
(2) Date: Aug. 29, 2017

(87) PCT Pub. No.: WO2016/139180
PCT Pub. Date: Sep. 9, 2016

(65) Prior Publication Data

US 2018/0058139 A1 Mar. 1, 2018

(30) Foreign Application Priority Data

Mar. 2, 2015 (EP) ..... 15157110

(51) Int. Cl.
*E06B 3/663* (2006.01)

(52) U.S. Cl.
CPC .. *E06B 3/66319* (2013.01); *E06B 2003/6638* (2013.01)

(58) Field of Classification Search
None
See application file for complete search history.

(56) References Cited

U.S. PATENT DOCUMENTS 2,094,381 A 9/1937 Slayter
2,303,897 A 12/1942 Smith
(Continued)

FOREIGN PATENT DOCUMENTS

CA 2275448 A1 7/1998
CA 2855278 A1 * 7/2013 ..... E06B 3/66319
(Continued)

OTHER PUBLICATIONS

Advisory Action issued for U.S. Appl. No. 14/942,902, filed Nov. 16, 2015 on behalf of Saint-Gobain Glass France, dated Jan. 5, 2017. 4 pages.
(Continued)

*Primary Examiner* — Chinessa T. Golden
(74) *Attorney, Agent, or Firm* — Steinfl + Bruno LLP

(57) ABSTRACT

A spacer for insulating glazing units is presented. The spacer has a polymeric main body with features that include two parallel side walls that are connected to one another by an inner wall and an outer wall. The side walls, the inner wall, and the outer wall surround a hollow chamber. According to one aspect, the polymeric main body has a glass fiber content of 0 wt.-% to 40 wt.-%, to which 0.5 wt.-% to 1.5 wt.-% of a foaming agent is added to form hollow spaces that provide a weight reduction of the polymeric main body of 10 wt.-% to 20 wt.-%.

19 Claims, 4 Drawing Sheets

(56) References Cited

U.S. PATENT DOCUMENTS

Figure 1:
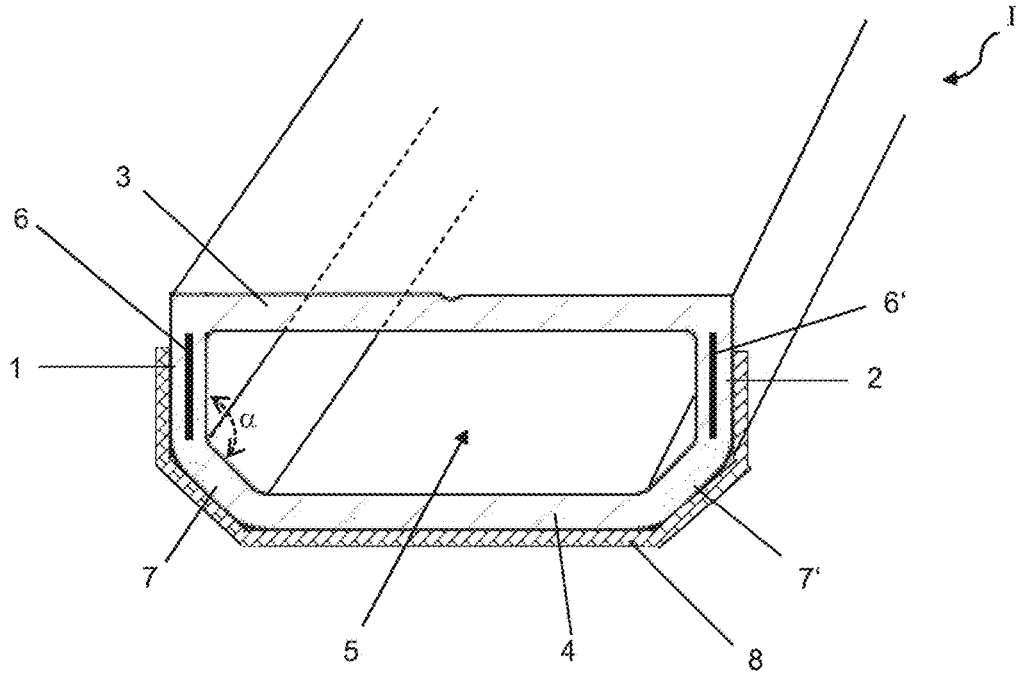

| | | | |
|---|---|---|---|
| 2,834,999 | A | 5/1958 | Taylor et al. |
| 3,168,089 | A | 2/1965 | Larkin |
| 3,793,276 | A | 2/1974 | Blunt et al. |
| 3,935,683 | A | 2/1976 | Derner et al. |
| 3,998,680 | A | 12/1976 | Flint |
| 4,080,482 | A | 3/1978 | Lacombe |
| 4,109,431 | A | 8/1978 | Mazzoni et al. |
| 4,198,254 | A | 4/1980 | Laroche et al. |
| 4,226,063 | A | 10/1980 | Chenel |
| 4,479,988 | A | 10/1984 | Dawson |
| 4,613,530 | A | 9/1986 | Hood et al. |
| 4,658,553 | A | 4/1987 | Shinagawa |
| 4,799,745 | A | 1/1989 | Meyer et al. |
| 4,831,799 | A | 5/1989 | Glover et al. |
| 5,007,217 | A | 4/1991 | Glover et al. |
| 5,071,206 | A | 12/1991 | Hood et al. |
| 5,079,054 | A | 1/1992 | Davies |
| 5,125,195 | A | 6/1992 | Brede |
| 5,173,800 | A | 12/1992 | King |
| 5,209,034 | A | 5/1993 | Box et al. |
| 5,270,092 | A | 12/1993 | Griffith et al. |
| 5,290,611 | A | 3/1994 | Taylor |
| 5,302,425 | A | 4/1994 | Taylor |
| 5,313,762 | A | 5/1994 | Guillemet |
| 5,424,111 | A | 6/1995 | Farbstein |
| 5,439,716 | A | 8/1995 | Larsen |
| 5,460,862 | A | 10/1995 | Roller |
| 5,512,341 | A | 4/1996 | Newby et al. |
| 5,655,282 | A | 8/1997 | Hodek et al. |
| 5,675,944 | A | 10/1997 | Kerr et al. |
| 5,679,419 | A | 10/1997 | Larsen |
| 5,762,257 | A | 6/1998 | Garrecht |
| 5,773,135 | A | 6/1998 | Lafond |
| 5,851,627 | A | 12/1998 | Farbstein |
| 5,962,090 | A | 10/1999 | Trautz |
| 6,001,453 | A | 12/1999 | Lafond |
| 6,002,521 | A | 12/1999 | Town |
| 6,060,178 | A | 5/2000 | Krisko |
| 6,061,994 | A | 5/2000 | Goer et al. |
| 6,115,989 | A | 9/2000 | Boone et al. |
| 6,223,414 | B1 | 5/2001 | Hodek et al. |
| 6,250,045 | B1 | 6/2001 | Goer et al. |
| 6,266,940 | B1 | 7/2001 | Reichert |
| 6,339,909 | B1 | 1/2002 | Brunnhofer |
| 6,351,923 | B1 | 3/2002 | Peterson |
| 6,389,779 | B1 | 5/2002 | Brunnhofer |
| 6,391,400 | B1 | 5/2002 | Russell et al. |
| 6,457,294 | B1 | 10/2002 | Virnelson et al. |
| 6,503,617 | B2 | 1/2003 | Jacobsen et al. |
| 6,528,131 | B1 | 3/2003 | Lafond |
| 6,537,629 | B1 | 3/2003 | Ensinger |
| 6,613,404 | B2 | 9/2003 | Johnson |
| 6,796,102 | B2 | 9/2004 | Virnelson et al. |
| 6,989,188 | B2 | 1/2006 | Brunnhofer et al. |
| 7,317,280 | B2 | 1/2008 | Qiu et al. |
| 7,827,760 | B2 | 11/2010 | Brunnhofer et al. |
| 7,858,193 | B2 | 12/2010 | Ihlo et al. |
| 7,997,037 | B2 | 8/2011 | Crandell et al. |
| 8,453,415 | B2 | 6/2013 | Brunnhofer et al. |
| 8,484,912 | B2 | 7/2013 | Engelmeyer |
| 8,640,406 | B2 | 2/2014 | Brunnhofer et al. |
| 8,701,363 | B2 | 4/2014 | Schield |
| 9,085,708 | B2 | 7/2015 | Becker et al. |
| 9,260,906 | B2 | 2/2016 | Schreiber et al. |
| 9,487,994 | B2 | 11/2016 | Lenz et al. |
| 10,167,665 | B2 | 1/2019 | Kuster et al. |
| 10,190,359 | B2 | 1/2019 | Messere et al. |
| 10,301,868 | B2 | 5/2019 | Kuster et al. |
| 10,344,525 | B2 | 7/2019 | Kuster et al. |
| 2001/0001357 | A1 | 5/2001 | Reichert |
| 2002/0192473 | A1 | 12/2002 | Gentilhomme et al. |
| 2003/0074859 | A1 | 4/2003 | Reichert et al. |
| 2004/0018335 | A1 | 1/2004 | Best et al. |
| 2004/0028953 | A1 | 2/2004 | Kraemling |
| 2004/0076815 | A1 | 4/2004 | Reichert |
| 2004/0163347 | A1 | 8/2004 | Hodek et al. |
| 2004/0256978 | A1 | 12/2004 | Yu et al. |
| 2005/0034386 | A1 | 2/2005 | Crandell et al. |
| 2005/0100691 | A1 | 5/2005 | Bunnhofer et al. |
| 2005/0170161 | A1 | 8/2005 | Ramchandra et al. |
| 2005/0214487 | A1 | 9/2005 | Trautz |
| 2005/0217718 | A1 | 10/2005 | Dings et al. |
| 2005/0287370 | A1 | 12/2005 | Kaczmarek et al. |
| 2006/0003138 | A1 | 1/2006 | Kaczmarek et al. |
| 2006/0013979 | A1* | 1/2006 | Ensinger ..... B01D 53/261 428/36.9 |
| 2006/0130427 | A1 | 6/2006 | Hodek et al. |
| 2006/0150577 | A1 | 7/2006 | Hodek et al. |
| 2006/0162281 | A1 | 7/2006 | Pettit et al. |
| 2006/0260227 | A1 | 11/2006 | Winfield |
| 2007/0087140 | A1 | 4/2007 | Dierks |
| 2007/0122572 | A1 | 5/2007 | Shibuya et al. |
| 2007/0251180 | A1 | 11/2007 | Gosling et al. |
| 2007/0261358 | A1 | 11/2007 | Davis et al. |
| 2007/0261795 | A1 | 11/2007 | Rosskamp et al. |
| 2008/0053037 | A1 | 3/2008 | Gallagher |
| 2008/0134596 | A1 | 6/2008 | Brunnhofer et al. |
| 2009/0120019 | A1 | 5/2009 | Trpkovski |
| 2009/0120035 | A1 | 5/2009 | Trpkovski |
| 2009/0139165 | A1 | 6/2009 | Prete et al. |
| 2009/0243802 | A1 | 10/2009 | Wolf et al. |
| 2009/0301637 | A1 | 12/2009 | Reichert et al. |
| 2010/0011703 | A1 | 1/2010 | Seele et al. |
| 2010/0107529 | A1 | 5/2010 | Engelmeyer |
| 2010/0255277 | A1 | 10/2010 | Platt et al. |
| 2011/0027476 | A1 | 2/2011 | Kirby et al. |
| 2011/0041427 | A1 | 2/2011 | Bouesnard |
| 2011/0275796 | A1 | 11/2011 | Seilz et al. |
| 2012/0132251 | A1 | 5/2012 | Sedlacek et al. |
| 2012/0141699 | A1 | 6/2012 | Maeder et al. |
| 2012/0297707 | A1 | 11/2012 | Lenz et al. |
| 2014/0138425 | A1 | 5/2014 | Meyer et al. |
| 2014/0272207 | A1 | 9/2014 | McKenna et al. |
| 2014/0356557 | A1 | 12/2014 | Reichert |
| 2015/0107167 | A1 | 4/2015 | Baumann et al. |
| 2016/0069123 | A1 | 3/2016 | Schreiber |
| 2016/0138326 | A1 | 5/2016 | Kuster et al. |
| 2016/0201381 | A1 | 7/2016 | Kuster et al. |
| 2016/0290032 | A1 | 10/2016 | Kuster et al. |
| 2016/0290033 | A1 | 10/2016 | Messere |
| 2017/0145734 | A1 | 5/2017 | Kuster et al. |
| 2017/0152701 | A1 | 6/2017 | Kuster et al. |
| 2017/0298680 | A1 | 10/2017 | Schreiber et al. |

FOREIGN PATENT DOCUMENTS

| | | | |
|---|---|---|---|
| CA | 2855278 | A1 | 7/2013 |
| CN | 1377329 | A | 10/2002 |
| CN | 1678810 | A | 10/2005 |
| DE | 2555384 | C3 | 3/1982 |
| DE | 3302659 | A1 | 8/1984 |
| DE | 2752542 | C2 | 10/1989 |
| DE | 4032192 | A1 | 6/1991 |
| DE | 4024697 | A1 | 2/1992 |
| DE | 9408764 | U1 | 10/1995 |
| DE | 4432402 | A1 | 3/1996 |
| DE | 19533685 | A1 | 3/1997 |
| DE | 19602455 | A1 | 7/1997 |
| DE | 19625845 | A1 | 1/1998 |
| DE | 19805348 | A1 | 8/1999 |
| DE | 19807454 | A1 | 8/1999 |
| DE | 1989151 | C1 | 2/2000 |
| DE | 69607473 | T2 | 9/2000 |
| DE | 19927683 | C1 | 1/2001 |
| DE | 10025321 | A1 | 1/2002 |
| DE | 10356216 | A1 | 7/2005 |
| DE | 102009006062 | A1 | 7/2010 |
| DE | 102009057156 | A1 | 6/2011 |
| DE | 102010006127 | A1 | 8/2011 |
| DE | 202012104026 | U1 | 10/2013 |
| DE | 69633132 | T2 | 8/2015 |
| EP | 0078530 | A2 | 5/1983 |
| EP | 0154428 | A2 | 9/1985 |
| EP | 0261923 | A2 | 3/1988 |

(56) References Cited

FOREIGN PATENT DOCUMENTS

| | | | |
|---|---|---|---|
| EP | 0430889 | A2 | 6/1991 |
| EP | 0597727 | A2 | 5/1994 |
| EP | 0612119 | A1 | 8/1994 |
| EP | 0852280 | A1 | 7/1998 |
| EP | 0865560 | B1 | 8/2004 |
| EP | 1607216 | A1 | 12/2005 |
| EP | 1607217 | A1 | 12/2005 |
| EP | 0912455 | B1 | 5/2006 |
| EP | 1892365 | A1 | 2/2008 |
| EP | 1218307 | B1 | 7/2008 |
| EP | 1917222 | B1 | 3/2009 |
| EP | 2218862 | A2 | 8/2010 |
| EP | 2359973 | A2 | 8/2011 |
| EP | 2363565 | A2 | 9/2011 |
| EP | 2420536 | A1 | 2/2012 |
| EP | 2584135 | A2 | 4/2013 |
| EP | 2628884 | A2 | 8/2013 |
| EP | 2802726 | B1 | 4/2016 |
| FR | 2205620 | A1 | 5/1974 |
| FR | 2799005 | A1 | 3/2001 |
| GB | 2103999 | A | 3/1982 |
| GB | 2210899 | A | 6/1989 |
| JP | H09175843 | A | 7/1997 |
| JP | H11189439 | A | 7/1999 |
| JP | H11247540 | A | 9/1999 |
| JP | 2002504639 | A | 2/2002 |
| JP | 2007277052 | A | 10/2007 |
| JP | 2008019131 | A | 1/2008 |
| WO | 97/48649 | A1 | 12/1997 |
| WO | 98/28513 | A1 | 7/1998 |
| WO | 01/16046 | A1 | 3/2001 |
| WO | 2004/005783 | A2 | 1/2004 |
| WO | 2007/042688 | A1 | 4/2007 |
| WO | 2007/101964 | A1 | 9/2007 |
| WO | 2008/022877 | A1 | 2/2008 |
| WO | 2010/034781 | A2 | 4/2010 |
| WO | 2010/115456 | A1 | 10/2010 |
| WO | 2011/088994 | A2 | 7/2011 |
| WO | 2012/095266 | A1 | 7/2012 |
| WO | 2012/140005 | A1 | 10/2012 |
| WO | 2013104507 | A1 | 7/2013 |
| WO | 2014/198429 | A1 | 12/2014 |
| WO | 2014/198431 | A1 | 12/2014 |

OTHER PUBLICATIONS

Amcor, Ceramis Coating Technology, Oct. 2012. 12 pages.

Final Office Action issued for U.S. Appl. No. 14/357,164, filed May 8, 2014 on behalf of Saint-Gobain Glass France, dated Feb. 9, 2015. 16 pages.

Final Office Action issued for U.S. Appl. No. 14/942,902, filed Nov. 16, 2015 on behalf of Saint-Gobain Glass France, dated Sep. 26, 2016. 33 pages.

Final Office Action issued for U.S. Appl. No. 14/909,073, filed Jan. 29, 2016 on behalf of Saint-Gobain Glass France, dated Jun. 20, 2017. 25 pages.

Final Office Action issued for U.S. Appl. No. 14/942,902, filed Nov. 16, 2015 on behalf of Saint-Gobain Glass France, dated Sep. 12, 2017. 29 pages.

International Search Report issued for International Patent Application No. PCT/EP2012/076341, filed Dec. 20, 2012 on behalf of Saint-Gobain Glass France, dated Feb. 8, 2013. 7 pages (English Translation and German Original).

International Search Report issued for International Patent Application No. PCT/EP2014/067901, filed Aug. 22, 2014 on behalf of Saint-Gobain Glass France, dated Oct. 7, 2014. 5 pages (English Translation and German Original).

International Search Report and Written Opinion for International Application No. PCT/EP2015/063814 filed on Jun. 19, 2015 in the name of Saint-Gobain Glass France, dated Aug. 14, 2015. 21 pages (English translation and German original).

International Search Report and Written Opinion for International Application No. PCT/EP2015/063821 filed on Jun. 19, 2015 in the name of Saint-Gobain Glass France, dated Aug. 19, 2015. 21 pages (English translation and German original).

Non-Final Office Action issued for U.S. Appl. No. 14/357,164, filed May 8, 2014 on behalf of Saint-Gobain Glass France, dated Aug. 10, 2015. 14 pages.

Non-Final Office Action issued for U.S. Appl. No. 14/357,164, filed May 8, 2014 on behalf of Saint-Gobain Glass France, dated Sep. 10, 2014. 24 pages.

Non-Final Office Action issued for U.S. Appl. No. 14/942,902, filed Nov. 16, 2015 on behalf of Saint-Gobain Glass France, dated Mar. 10, 2016. 28 pages.

Non-Final Office Action issued for U.S. Appl. No. 14/942,902, filed Nov. 16, 2015 on behalf of Saint-Gobain Glass France, dated Apr. 4, 2017. 23 pages.

Non-Final Office Action issued for U.S. Appl. No. 14/909,073, filed Jan. 29, 2016 on behalf of Saint-Gobain Glass France, dated Apr. 4, 2017. 23 pages.

Non-Final Office Action issued for U.S. Appl. No. 14/909,073, filed Jan. 29, 2016 on behalf of Saint-Gobain Glass France, dated Aug. 25, 2017. 26 pages.

Notice of Allowance issued for U.S. Appl. No. 14/357,164, filed May 8, 2014 on behalf of Saint-Gobain Glass France, dated May 18, 2015. 12 pages.

Notice of Allowance issued for U.S. Appl. No. 14/357,164, filed May 8, 2014 on behalf of Saint-Gobain Glass France, dated Jun. 22, 2015. 8 pages.

Notice of Allowance issued for U.S. Appl. No. 14/357,164, filed May 8, 2014 on behalf of Saint-Gobain Glass France, dated Sep. 28, 2015. 12 pages.

Notice of Allowance issued for U.S. Appl. No. 14/357,164, filed May 8, 2014 on behalf of Saint-Gobain Glass France, dated Nov. 23, 2015. 14 pages.

Opposition by opponent Camvac Limited in European Patent 2,802,726 B1, issued Apr. 27, 2016 to Saint-Gobain Glass France. Mail date: Jan. 27, 2017. 16 pages.

Annex A to opposition by opponent Camvac Limited. "Press notes and articles from 2011". May-Aug. 2011. 4 pages.

Annex B to opposition by opponent Camvac Limited. "Invoices and delivery notes from Thermoseal Group Ltd from Aug. 2011 to Dec. 2011". Aug.-Dec. 2011. 24 pages.

Annex BB to opposition by opponent Camvac Limited. "Invoice and delivery note from Thermoseal Group Ltd of Aug. 2011". Aug. 2011. 2 pages.

Annex C1 to opposition by opponent Camvac Limited. "Thermobar production sheets from Thermoseal Group Ltd of Dec. 22, 2011 and Dec. 23, 2011". Dec. 22 and 23, 2011. 2 pages.

Annex C2 to opposition by opponent Camvac Limited. "Stock Control from Thermoseal Group Ltd from Jun. 8, 2011 to Dec. 22, 2011". Jun. 8, 2011-Dec. 22, 2011. 14 pages.

Annex C3 to opposition by opponent Camvac Limited. "Invoices No. 47197, 47486 and 47812 from Lohmann of Jun. 30, 2011, Aug. 26, 2011 and Oct. 31, 2011". Jun. 30, 2011, Aug. 26, 2011, and Oct. 31, 2011. 3 pages.

Annex CC1 to opposition by opponent Camvac Limited. "Thermobar production sheets from Thermoseal Group Ltd of Aug. 8, 2011 and Sep. 26, 2011". Aug. 8, 2011 and Sep. 26, 2011. 2 pages.

Annex CC2 to opposition by opponent Camvac Limited. "Stock Control from Thermoseal Group Ltd of Jul. 29, 2011 and Sep. 6, 2011". Jul. 29, 2011 and Sep. 6, 2011. 1 page.

Annex CC3 to opposition by opponent Camvac Limited. "Invoice No. 47340 from Lohmann of Jul. 29, 2011". Jul. 29, 2011. 1 page.

Annex D1 to opposition by opponent Camvac Limited. "Preliminary Data Sheet—Duplocoll 40024". No date. 1 page.

Annex E to opposition by opponent Camvac Limited. "Delivery Notes with purchase order Nos. 7621, 7684, 7756, 7757 and 7832 from Camvac Limited of May 24, 2011, Jun. 8 and 29, 2011, Jul. 22, 2011, and Aug. 18, 2011". May 24, 2011, Jun. 8, 2011, Jun. 29, 2011, Jul. 22, 2011, and Aug. 18, 2011. 5 pages.

Annex F1 to opposition by opponent Camvac Limited. "Data Sheet 12/12 Cambrite film from Camvac". No date. 2 pages.

(56) References Cited

OTHER PUBLICATIONS

Annex F1A to opposition by opponent Camvac Limited. "Screen shot of Data Sheet 12/12 Cambrite film from Camvac". Jan. 19, 2017. 1 page.
Annex F1B to opposition by opponent Camvac Limited. "Declaration of Mr Gary Chalkley (Camvac Product Development Director)". Jan. 24, 2017. 1 page.
Annex F2 to opposition by opponent Camvac Limited. "Declaration of Mr. James Shipman (Camvac Process Development Manager)". Jan. 24, 2017. 2 pages.
Annex G to opposition by opponent Camvac Limited. "Data sheet PSI values for windows having a Thermobar Warm Edge Spacer". Nov. 2014. 1 page.
Opposition by opponent Ensinger GmbH in European Patent 2,802,726 B1, issued Apr. 27, 2016 to Saint-Gobain Glass France, dated Jan. 27, 2017. 44 pages (English Translation + German Original).
Annex D1A to opposition by opponent Ensinger GmbH. "Affidavit of Mr. Marc Rehling". Jan. 24, 2017. 4 pages (English Translation + German Original).
Annex D1B to opposition by opponent Ensinger GmbH. "Photography of "Thermobar"Spacer". No date. 1 page.
Annex D1C to opposition by opponent Ensinger GmbH "Test Report AP 16-11-98". Nov. 2016. 8 pages (German Original Only).
Annex D1D to opposition by opponent Ensinger GmbH. "Figure 5 of D1C with annotations". 13 pages. No date. (English Translation + German Original).
Annex D1E to opposition by opponent Ensinger GmbH. "ATR-Infrared Spectroscopy Measurement of the "Thermobar" Spacer". Dec. 12, 2016. 2 pages. (English Translation + German Original).
Annex D1F to opposition by opponent Ensinger GmbH. "Expert Opinion on "Thermobar" Spacer". Jan. 18, 2017. 14 pages. (English Translation + German Original).
Annex D2 to opposition by opponent Ensinger GmbH. "DIN EN ISO 10077-1 in the version dated May 2010". May 2010. 48 pages. (English Translation + German Original).
Annex D7 to opposition by opponent Ensinger GmbH. "Avis Technique [Technical Evaluation] 6/04-1562 regarding the Super Spacer Premium and the Super Spacer Premium Plus the Edgetech Europe GmbH". Jan. 4, 2005. 46 pages. (English Translation + German Original).
Opposition by opponent Helima GmbH in European Patent 2,802,726 B1, issued Apr. 27, 2016 to Saint-Gobain Glass France. Mail date: Jan. 27, 2017. 159 pages. (English Translation + German Original).
Supplement to opposition by opponent Helima GmbH in European Patent 2,802,726 B1, issued Apr. 27, 2016 to Saint-Gobain Glass France. Mail date: Mar. 23, 2017. 6 pages. (English Translation + German Original).
Annex Al to opposition by opponent Helima GmbH. "Excerpt from the website of the company Viking regarding Window DK88". Sep. 2012. 4 pages.
Annex A2 to opposition by opponent Helima GmbH. "Excerpt from the Polish website of the patent holder". Nov. 12, 2012. 3 pages. (English Translation + German Original).
Annex A3 to opposition by opponent Helima GmbH. "Technical Opinion 6/13-2124*01 Add of the CSTB". Sep. 24, 2014. 60 pages. (English Translation + French Original).
Annex A4 to opposition by opponent Helima GmbH. "Technical Opinion 6/16-2303 of the CSTB". Jun. 30, 2016. 62 pages. (English Translation + French Original).
Annex A5 to opposition by opponent Helima GmbH. "Datasheet Swisspacer Ultimate". Apr. 2013. 2 pages. (English Translation + German Original).
Annex A6 to opposition by opponent Helima GmbH. "Excerpt from AIMCAL "Metallizing Technical Reference"". May 2012. 2 pages.
Annex A7 to opposition by opponent Helima GmbH. "Excerpt from Frick/Knoll: Baukonstruktionslehre [Structural Design Theory] 2, Ed.34". Hestermann and Rongen, "Frick/Knöll Baukonstruktionslehre 2", pp. 371-372, 2013. 4 pages. (German Original Only).
Annex A8 to opposition by opponent Helima GmbH. "Affidavit". Jan. 27, 2017. 2 pages.
Annex A9 to opposition by opponent Helima GmbH. "Datasheet Sanco ACS Thermix". Jun. 2009. 5 pages. (English Translation + German Original).
Annex A10 to opposition by opponent Helima GmbH. "Barrier films for vacuum insulation panels (VIP)". Kaczmarek, "Barrier films for vacuum insulation panels (VIP)", $7_{th}$ International Vacuum Insulation Symposium 2005, pp. 91-98, 2005. 8 pages.
Opposition by opponent Rolltech A/S in European Patent 2,802,726 B1, issued Apr. 27, 2016 to Saint-Gobain Glass France. Mail date: Jan. 27, 2017. 32 pages.
Annex O1i to opposition by opponent Rolltech A/S. "Ceramis Barrier Films by Alcan Packaging". Mar. 2005. 4 pages.
Annex O1ii to opposition by opponent Rolltech A/S. "'Barrier Films: SiOx Barrier Benefits' by Marius Breune in Paper, Film & Foil Converter". Oct. 1, 2010. 4 pages.
Opposition by opponent Technoform Glass Insulation Holding GmbH in European Patent 2,802,726 B1, issued Apr. 27, 2016 to Saint-Gobain Glass France. Mail Date: Jan. 26, 2017. 55 pages. (English Translation + German Original).
Annex E6a to opposition by opponent Technoform Glass Insulation Holding GmbH. "ISO 10077-1 in the version of 2006". Sep. 15, 2006. 42 pages.
Annex E6b to opposition by opponent Technoform Glass Insulation Holding GmbH. "ISO 10077-2 in the version of 2012". Mar. 1, 2012. 44 pages.
Annex E6c to opposition by opponent Technoform Glass Insulation Holding GmbH. "two data sheets Saint-Gobain Swisspacer from 2008". Oct. 2008. 2 pages.
Opposition by opponent Thermoseal Group Ltd in European Patent 2,802,726 B1, issued Apr. 27, 2016 to Saint-Gobain Glass France. Mail date: Jan. 27, 2017. 20 pages.
Annex A to opposition by opponent Thermoseal Group Ltd. "Press notes and articles from 2011". May-Sep. 2011. 4 pages.
Annex B to opposition by opponent Thermoseal Group Ltd. "Invoices and delivery notes from Thermoseal Group Ltd from Aug. 2011 to Dec. 2011". Aug.-Dec. 2011. 24 pages.
Annex BB to opposition by opponent Thermoseal Group Ltd. "Invoice and delivery note from Thermoseal Group Ltd of Aug. 2011". Aug. 2011. 2 pages.
Annex C1 to opposition by opponent Thermoseal Group Ltd. "Thermobar production sheets from Thermoseal Group Ltd of Dec. 22, 2011 and Dec. 23, 2011". Dec. 22 and 23, 2011. 2 pages.
Annex C2 to opposition by opponent Thermoseal Group Ltd. "Stock Control from Thermoseal Group Ltd from Jun. 8, 2011 to Dec. 22, 2011". Jun. 8, 2011-Dec. 22, 2011. 14 pages.
Annex C3 to opposition by opponent Thermoseal Group Ltd. "Invoices No. 47197, 47486 and 47812 from Lohmann of Jun. 30, 2011, Aug. 26, 2011 and Oct. 31, 2011". Jun. 30, 2011, Aug. 26, 2011, Oct. 31, 2011. 3 pages.
Annex CC1 to opposition by opponent Thermoseal Group Ltd. "Thermobar production sheets from Thermoseal Group Ltd of Aug. 8, 2011 and Sep. 26, 2011". Aug. 8, 2011 and Sep. 26, 2011. 2 pages.
Annex CC2 to opposition by opponent Thermoseal Group Ltd. "Stock Control from Thermoseal Group Ltd of Jul. 29, 2011 and Sep. 6, 2011". Jul. 29, 2011 and Sep. 6, 2011. 1 page.
Annex CC3 to opposition by opponent Thermoseal Group Ltd. "Invoice No. 47340 from Lohmann of Jul. 29, 2011". Jul. 29, 2011. 1 page.
Annex D1 to opposition by opponent Thermoseal Group Ltd. "Preliminary Data Sheet—Duplocoll 40024". No date. 1 page.
Annex D2 to opposition by opponent Thermoseal Group Ltd. "Declaration of Ms Amanda Smith (Lohmann Segment Manager)". Jan. 18, 2014. 1 page.
Annex E to opposition by opponent Thermoseal Group Ltd. "Delivery Notes with purchase order Nos. 7621, 7684, 7756, 7757 and 7832 from Camvac Limited of May 24, 2011, Jun. 8 and 29, 2011, Jul. 22, 2011 and Aug. 18, 2011". Jul. 22, 2011 and Aug. 18, 2011. 6 pages.
Annex F1 to opposition by opponent Thermoseal Group Ltd. "Data Sheet of 12/12 Cambrite film from Camvac". No date. 2 pages.
Annex F1A to opposition by opponent Thermoseal Group Ltd. "Screen shot showing the last date that the 12/12 Cambrite film from Camvac data sheet was modified". Jan. 19, 2017. 1 page.

(56) References Cited

OTHER PUBLICATIONS

Annex F2 to opposition by opponent Thermoseal Group Ltd. "Declaration of Mr James Shipman (Camvac Process Development Manager)". Jan. 24, 2017. 2 pages.
Annex G to opposition by opponent Thermoseal Group Ltd. "Data sheet PSI values for windows having a Thermobar Warm Edge Spacer". Nov. 2014. 1 page.
Annex D1C to opposition by opponent Ensinger GmbH (Jan. 27, 2017) in European Patent 2,802,726 B1 (issued to Saint-Gobain Glass France). "Test Report, Light micrographs of two existing polished sections with the designation 2010 und 2011", Institute of Polymertechnology, Nov. 2016, 16 pages (English Translation + German Original).
Annex A7 to opposition by opponent Helima GmbH (Jan. 27, 2017) in European Patent 2,802,726 B1 (issued to Saint-Gobain Glass France). Hestermann and Rongen, "Frick/Knöll Baukonstruktionslehre 2", pp. 371-372, 1996-2013, 10 pages (English Translation + German Original).
Response to notices of opposition against European Patent EP 2 802 726 B1 by the companies Technoform Glass Insulation Holding GmbH (O1), Ensinger GmbH (O2), Camvac Limited (O3), Thermoseal Group Limited (O4), Rolltech A/S (O5), Helima GmbH (O6). Mail Date: Aug. 22, 2017. 119 pages (English Translation + German Original).
M.W. Phaneuf, "Applications of focused ion beam microscopy to materials science specimens", Micron 30. Jan. 28, 1999. pp. 277-288.
Bishop et al., "Metallizing Technical Reference", AIMCAL, May 2012. Title and pp. 21-25. 6 pages.
International Search Report for PCT/EP2016/054226 filed on Feb. 29, 2016 in the name of Saint-Gobain Glass France, dated May 3, 2016. 5 pages. (German & English).
EPO Preliminary Opinion for European Patent Application No. 12806056.3 filed Jun. 11, 2014 on behalf of SAINT-GOBAIN GLASS FRANCE, dated Jul. 23, 2018. 34 pages. (English Translation + German Original).
Final Office Action for U.S. Appl. No. 14/942,902, filed Nov. 16, 2015, on behalf of Saint-Gobain Glass France, dated Sep. 14, 2018. 21 pgs.
International Preliminary Report on Patentability Chapter I for Application No. PCT/EP2012/076341, dated Jul. 15, 2014, 17 pages (English Translation + German Original).
International Preliminary Report on Patentability for International Application No. PCT/EP2014/076739 filed Dec. 5, 2014 on behalf of SAINT-GOBAIN GLASS FRANCE, dated Jun. 14, 2016. 15 pages (English Translation + German Original).
International Preliminary Report on Patentability for International Application No. PCT/EP2016/054226 filed Feb. 29, 2016 on behalf of SAINT-GOBAIN GLASS FRANCE, dated Sep. 5, 2016. 6 pages. (English Translation + German Original).
International Search Report for Application No. PCT/EP2014/076736, dated Mar. 10, 2016, 5 pages (German original + English Translation).
International Search Report for Application No. PCT/EP2014/076739, dated Feb. 3, 2015, 7 pages (English Translation + German Original).
International Search Report for International Application No. PCT/EP2015/071452, dated Dec. 2, 2015. 7 pages (English Translation + German Original).
Non-Final Office Action for U.S. Appl. No. 14/942,902, dated Jan. 3, 2018, 20 pages.
Non-Final Office Action for U.S. Appl. No. 15/038,298, dated Dec. 28, 2017, 15 pages.
Non-Final Office Action for U.S. Appl. No. 15/038,356, dated Feb. 22, 2018, 7 pages.
Non-Final Office Action for U.S. Appl. No. 15/321,161, dated Mar. 20, 2018, 15 pages.
Non-Final Office Action for U.S. Appl. No. 15/321,170, dated Mar. 22, 2018, 9 pages.
Non-Final Office Action for U.S. Appl. No. 15/506,229, filed Feb. 23, 2017, on behalf of Saint-Gobain Glass France, dated Dec. 20, 2018. 24 pages.
Notice of Allowance for U.S. Appl. No. 15/038,298, filed May 20, 2016, on behalf of Saint-Gobain Glass France, dated Oct. 9, 2018. 14 pgs.
Notice of Allowance for U.S. Appl. No. 15/038,298, dated May 31, 2018, 8 pages.
Notice of Allowance for U.S. Appl. No. 15/038,356, filed May 20, 2016, on behalf of Saint-Gobain Glass France, dated Oct. 15, 2018. 8 pgs.
Notice of Allowance for U.S. Appl. No. 15/321,161, filed Dec. 21, 2016 on behalf of Saint-Gobain Glass France, dated Feb. 26, 2019. 24 pages.
Notice of Allowance for U.S. Appl. No. 15/321,170, filed Dec. 21, 2016 on behalf of Saint-Gobain Glass France, dated Feb. 27, 2019. 28 pages.
Restriction Requirement for U.S. Appl. No. 15/038,356, dated Jan. 16, 2018, 7 pages.
Restriction Requirement for U.S. Appl. No. 15/321,161, filed Dec. 21, 2016, on behalf of Saint-Gobain Glass France, dated Oct. 3, 2018. 7 pgs.
Restriction Requirement for U.S. Appl. No. 15/321,170, filed Dec. 21, 2016, on behalf of Saint-Gobain Glass France, dated Oct. 5, 2018. 8 pgs.
Restriction Requirement for U.S. Appl. No. 15/506,229, filed Feb. 23, 2017 on behalf of Saint-Gobain Glass France, dated Aug. 23, 2018. 6 pages.
Written Opinion for Application No. PCT/EP2012/076341, dated Feb. 8, 2013, 15 pages (English Translation and German Original).
Written Opinion for Application No. PCT/EP2014/076736, dated Mar. 10, 2016, 10 pages (English Translation+ German Original).
Written Opinion for Application No. PCT/EP2015/063821, dated Aug. 19, 2015, 16 pages (English Translation and German Original).
Written Opinion for Application No. PCT/EP2015/071452 filed Sep. 18, 2015 on behalf of Saint-Gobain Glass France, dated Dec. 2, 2015, 11 pages (English Translation + German Original).
Written Opinion for International Application No. PCT/EP2014/067901 filed Aug. 22, 2014 on behalf of Saint-Gobain Glass France, dated Oct. 7, 2014. 13 pages (English Translation + German Original).
Written Opinion for International Application No. PCT/EP2016/054226 filed Feb. 29, 2016 on behalf of Saint-Gobain Glass France, dated May 3, 2016. 9 pages (English translation + German Original).
Mattox D. et al "Handbook of Physical Vapor Deposition (PVD) Processing" *Society of Vacuum Coaters*, Cambridge University Press, Jan. 2009, pp, vi,vii,ix-xxviii,29-34,327,393,394,537; 34 pages.
Meyers M. et al., "Mechanical Behavior of Materials" *Cambridge University Press*, 2nd edition, Noyes Publication, Jan. 1998, pp. 767-768, 777, 782.
Non-Final Office Action for U.S. Appl. No. 14/942,902, filed Nov. 16, 2015 on behalf of Saint-Gobain Glass France, dated Mar. 28, 2019 22 pages.

* cited by examiner

GLASS-FIBER-REINFORCED SPACER FOR INSULATING GLAZING UNIT

CROSS-REFERENCE TO RELATED APPLICATIONS

The present application is the U.S. National Stage of International Patent Application No. PCT/EP2016/054226 filed on Feb. 29, 2016 which, in turn, claims priority to European Patent Application No. 15157110.6 filed on Mar. 2, 2015.

The invention relates to a glass-fiber-reinforced spacer for an insulating glazing unit, a method for its production, and its use.

In the window and facade region of buildings, insulating glazing units are used almost exclusively nowadays. Insulating glazing units consist for the most part of two glass panes, which are arranged at a defined distance from each other by means of a spacer. The spacer is arranged peripherally in the edge region of the glazing unit. An intermediate space, which is usually filled with an inert gas, is thus formed between the panes. The flow of heat between the interior space delimited by the glazing unit and the external environment can be significantly reduced by the insulating glazing unit compared to a simple glazing.

The spacer has a non-negligible influence on the thermal properties of the pane. Conventional spacers are made of a light metal, customarily aluminum. These can be easily processed. The spacer is typically produced as a straight endless profile, which is cut to the necessary size and then brought by bending into the rectangular shape necessary for use in the insulating glazing unit. Due to the good thermal conductivity of the aluminum, the insulating effect of the glazing unit is, however, significantly reduced in the edge region (cold edge effect).

In order to improve the thermal properties, so-called "warm edge" solutions for spacers are known. These spacers are made in particular of plastic and, consequently, have significantly reduced thermal conductivity. Plastic spacers are known, for example, from DE 27 52 542 C2 or DE 19 625 845 A1.

WO 20131104507 A1 discloses a spacer with a polymeric main body and an insulation film. The insulation film contains a polymeric film and at least two metallic or ceramic layers that are arranged alternatingly with at least one polymeric layer, with the outer layers preferably being polymeric layers. The metallic layers have a thickness of less than 1 μm and have to be protected by polymeric layers. Otherwise, damage to the metallic layers readily occurs during automated processing of the spacer during assembly of the insulating glazing units.

EP 0 852 280 A1 discloses a spacer for multipane insulating glazing units. The spacer includes a metal foil with a thickness of less than 0.1 mm on the adhesive surface and glass fiber content in the plastic of the main body. During further processing in the insulating glazing unit, the outer metal foil is exposed to high mechanical stresses. In particular, when spacers are further processed on automated production lines, damage to the metal foil and, thus, degradation of the barrier action readily occur.

There exists a need for spacers for insulating glazing units, which ensure minimal thermal conductivity and are nevertheless simple to process. In particular, there is a need for spacers with which the retention of the mechanical properties can be further improved and which can be produced with reduced costs.

The object of the present invention is to provide such a spacer for insulating glazing production. A further object of the present invention is to provide a method for producing such a spacer for insulating glazing production. Yet another object of the present invention is to provide a use of such a spacer for insulating glazing production.

The object of the present invention is accomplished by a spacer for insulating glazing production according to the independent claims. Preferred embodiments of the invention are apparent from the subclaims.

The object of the present invention is accomplished by a spacer for insulating glazing production that comprises a polymeric main body that has at least two parallel side walls, which are connected to one another by an inner wall and an outer wall, wherein the side walls, the inner wall, and the outer wall surround a hollow chamber, wherein the main body has a glass fiber content of 0 wt.-% to 40 wt.-% and has a weight reduction of 10 wt.-% to 20 wt,-% due to enclosed gas-filled hollow spaces.

The present object is achieved by a spacer for the insulating glazing unit according to the invention that is produced by the foaming of the plastic during the extrusion process. The spacer according to the invention has an improvement of the thermal properties while retaining the mechanical properties with reduced production costs.

In the spacer according to the invention, due to foaming during the extrusion, the walls of the hollow profile are no longer implemented as solid material but are, instead, permeated by gas bubbles, i.e., hollow spaces. In this manner, depending on the case, up to 10 wt.-% to 20 wt.-%, preferably from 11 wt.-% to 14 wt.-% of the material can be saved.

The spacer according to the invention has substantially higher strength and fracture resistance. The spacer according to the invention has substantially higher elasticity.

With the spacer according to the invention, a glass-fiber-reinforced plastic is improved in its thermal properties by slight foaming during extrusion, without degrading its mechanical properties. For the thermal properties, an improvement of as much as 45% has been measured. The thermal properties are greatly improved by the gases entrapped in the hollow spaces. The inactive gases entrapped in the hollow spaces act as a very good insulator.

A preferred embodiment of the present invention is a spacer, wherein the enclosed gas-filled hollow spaces are obtained by addition of at least one foaming agent. Preferably, this is chemical foaming. A blowing agent, in most cases in the form of a so-called masterbatch granulate is added to the plastic granulate. By addition of heat, a volatile component, usually carbon dioxide, separates from the blowing agent, resulting in the foaming of the molten material.

A preferred embodiment of the present invention is a spacer, wherein the amount of the foaming agent added is 0.5 wt.-% to 1.5 wt.-%. The foaming agent is added in granulate form to the polymer before the melting in the extruder.

A preferred embodiment of the present invention is a spacer, wherein the amount of the foaming agent added is 0.7 wt.-% to 1.0 wt.-%. In this range. particularly good results are obtained with the foaming agent.

A preferred embodiment of the present invention is a spacer, wherein the main body contains 1.0 wt.-% to 4.0 wt.-%, preferably 1.3 wt.-% to 2.0 wt.-% color masterbatch. In this range, particularly good coloring action is obtained, In the context of the invention, "color masterbatch" means a plastic additive in the form of a granulate that contains a colorant.

A preferred embodiment of the present invention is a spacer, wherein the main body (I) is fracture-resistant up to an applied force of 1800 N to 2500 N. The high fracture resistance is very advantageous for the spacer.

A preferred embodiment of the present invention is a spacer, wherein the main body (I) contains at least, polyethylene (PE), polycarbonates (PC), polystyrene, polybutadiene, polynitriles, polyesters, polyurethanes, polymethylmethacrylates, polyacrylates, polyamides, polyethylene terephthalate (PET), polybutylene terephthalate (PBT), preferably polypropylene (PP), acrylonitrile butadiene styrene (ABS), acrylonitrile styrene acrylester (ASA), acrylonitrile butadiene styrene; polycarbonate (ABS/PC), styrene acrylonitrile (SAN), polyethylene terephthalate/polycarbonate (PET/PC), polybutylene terephthalate/polycarbonate (PBT/PC) or copolymers or derivatives or mixtures thereof.

A particularly preferred embodiment of the present invention is a spacer, wherein the main body (I) contains at least, styrene acrylonitrile (SAN) or polypropylene (PP), or copolymers or derivatives or mixtures thereof. With these polymers, in particular with foaming, very good results are obtained in terms of thermal properties as well as fracture resistance and elasticity.

A preferred embodiment of the present invention is a spacer, wherein the spacer has, at least on the outer wall, an insulation film that contains a polymeric carrier film and at least one metallic or ceramic layer; the thickness of the polymeric carrier film of the insulation film is from 10 μm to 100 μm and the thickness of the metallic or ceramic layer of the insulation film is from 10 nm to 1500 nm, and wherein the installation film contains at least one more polymeric layer with a thickness of 5 μm to 100 μm and the metallic or ceramic layer of the insulation film contains at least iron, aluminum, silver, copper, gold, chromium, silicon oxide, silicon nitride, or alloys or mixtures or oxides thereof, and wherein the polymeric carrier film of the insulation film contains at least polyethylene terephthalate, ethylene vinyl alcohol, polyvinylidene chloride, polyamides, polyethylene, polypropylene, silicones, acrylonitriles, polymethyl acrylates, or copolymers or mixtures.

A preferred embodiment of the present invention is a spacer, wherein, in each side wall, a reinforcing strip is embedded, which contains at least a metal or a metallic alloy, preferably steel, and has a thickness of 0.05 mm to 1 mm, and a width of 1 mm to 5 mm. By means of the embedded reinforcing strip, the spacer obtains unexpected stability.

The reinforcing strips give the spacer the necessary bendability to be processed even with conventional industrial systems. The spacer can be bent into its final shape without having to be previously heated. By means of the reinforcing strips, the shape remains durably stable. In addition, the reinforcing strip increases the stability of the spacer. The reinforcing strips do not, however, act as a thermal bridge such that the properties of the spacer in terms of thermal conduction are not substantially adversely affected. There are, in particular, two reasons for this: (a) the reinforcing strips are embedded in the polymeric main body, thus have no contact with the environment; (b) the reinforcing strips are arranged in the side walls and not, for example, in the outer wall or the inner wall, via which the heat exchange between the interpane space and the external environment occurs. The simultaneous realization of bendability and optimum thermal properties as well as the increased fracture resistance and elasticity are key advantages of this preferred embodiment.

The object of the present invention is further accomplished by a method for producing a spacer for an insulating glazing unit, wherein a) a mixture of at least one polymer, color masterbatch, and foaming agent is prepared,
b) the mixture is melted in an extruder at a temperature of 170° C. to 230° C.,
c) the foaming agent is decomposed and volatile components foam the molten material,
d) the molten material is pressed by a mold and a main body it is obtained,
e) the main body is stabilized, and
f) the main body is cooled.

A preferred embodiment of the present invention is a method, wherein a granulate mixture at least containing 95.0 wt.-% to 99.0 wt.-% polymer with 30.0 wt.-% to 40.0 wt.-% glass fibers, 1.0 wt.-% to 4.0 wt.-% color masterbatch, and 0.5 wt.-% to 1.5 wt.-% foaming agent is provided. This mixing ratio is particularly advantageous for producing a foamed spacer.

A preferred embodiment of the present invention is a method, wherein the mixture is melted in an extruder at a temperature of 215° C. to 220° C. With these melting temperatures, very good results are obtained with the foamed spacer.

The invention further includes the use of the spacer according to the invention in multiple glazing units, preferably in insulating glazing units. The insulating glazing units are preferably used as window glazings or facade glazings of buildings, In the following, the invention is explained in detail with reference to drawings and exemplary embodiments. The drawings are a schematic representation and not true to scale. The drawings in no way restrict the invention.

Figure 2:
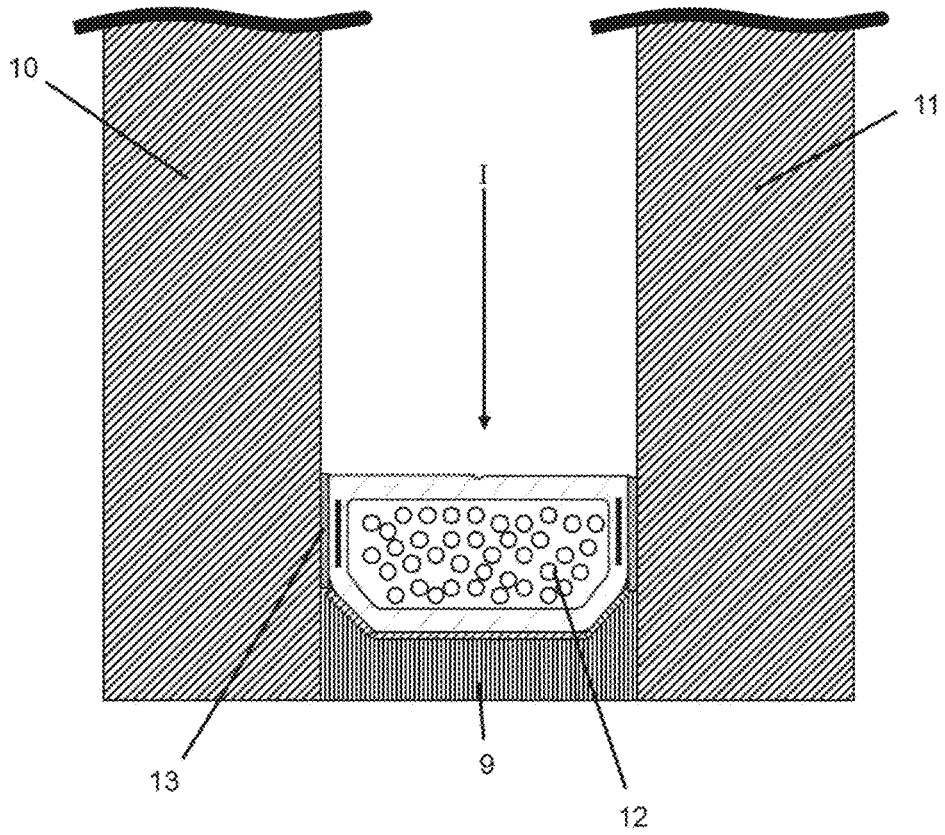
Figure 3:
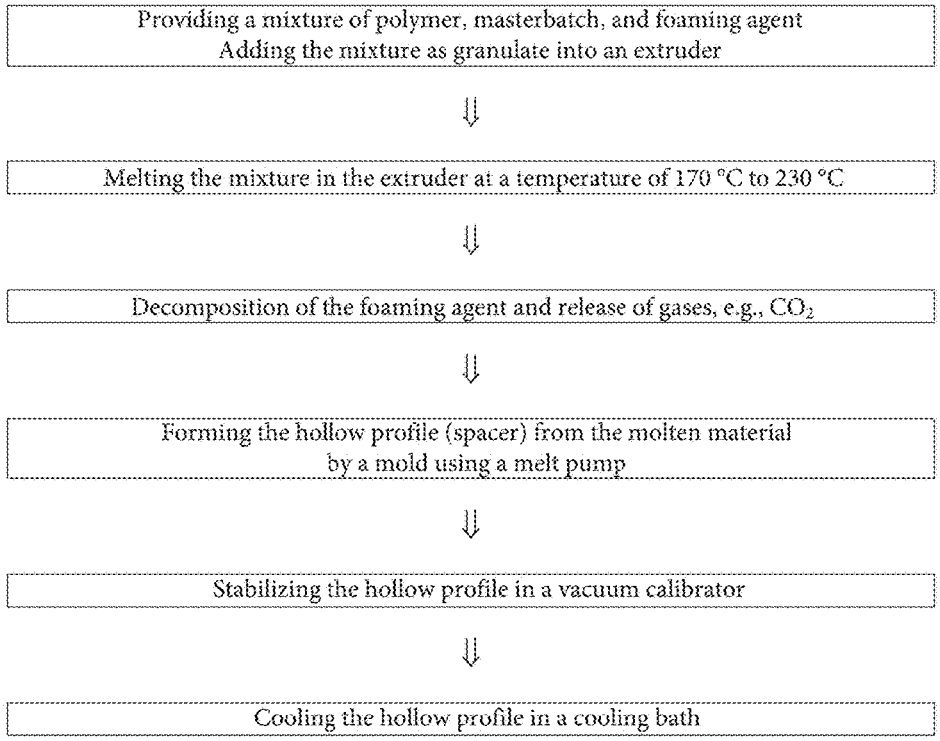
Figure 4:
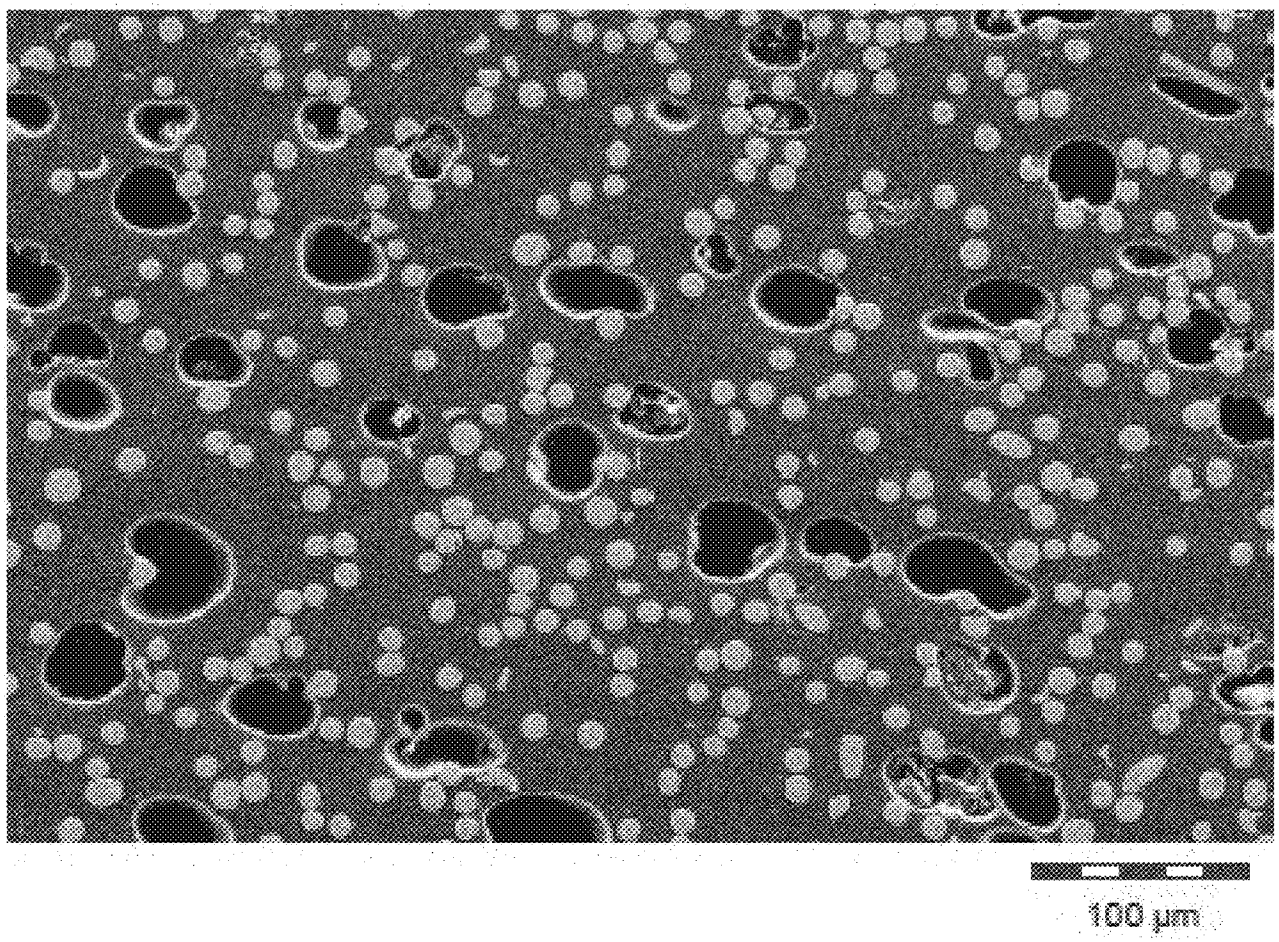

They depict:

FIG. 1 a perspective cross-section through an embodiment of the spacer according to the invention, FIG. 2 a cross-section through an embodiment of the insulating glazing unit according to the invention with the spacer according to the invention, FIG. 3 a flowchart of an embodiment of the method according to the invention, FIG. 4 a microscopic photograph of the cross-section of the foamed hollow profile.

FIG. 1 depicts a cross-section through a spacer according to the invention for an insulating glazing unit. The spacer comprises a polymeric main body I, made, for example, of polypropylene (PP) or of styrene acrylonitrile (SAN). The polymer has a glass fiber content of 0 wt.-% to 40 wt.-%.

The main body I comprises two parallel side walls 1, 2 that are intended to be brought into contact with the panes of the insulating glazing. In each case, between one end of each side wall 1, 2, runs an inner wall 3 that is intended to face the interpane space of the insulating glazing. At the other ends of the side walls 1, 2, a connection section 7, 7' is connected in each case. Via the connecting sections 7, 7', the side walls 1, 2 are connected to an outer wall 4 that is implemented parallel to the inner wall 3. The angle α between the connecting sections 7 (or 7') and the side wall 3 (or 4) is roughly 45'. The result of this is that the angle between the outer wall 4 and the connecting sections 7, 7' is also roughly 45'. The main body I surrounds a hollow chamber 5.

The material thickness (thickness) of the side walls 1, 2, of the inner wall 3, of the outer wall 4, and of the connecting sections 7, 7' is roughly the same and is, for example, 1 mm. The main body has, for example, a height of 6.5 mm and a width of 15 mm.

A reinforcing strip 6 is preferably embedded in each side wall 1, 2. The reinforcing strips 6, 6' are made of steel, which is not stainless steel, and they have a thickness (material thickness) of, for example, 0.3 mm and a width of, for example, 3 mm The length of the reinforcing strips 6, 6' corresponds to the length of the main body I.

The reinforcing strips give the basic body I sufficient bendability and stability to be bent without prior heating and to durably retain the desired shape. In contrast to other solutions according to the prior art, the spacer here has very low thermal conductivity since the metallic reinforcing strips 6, 6' are embedded only in the side walls 1, 2, via which only a very small part of the heat exchange between the pane interior and the external environment occurs. The reinforcing strips 6, 6' do not act as thermal bridges. These are major advantages of the present invention.

An insulation film 8 is preferably arranged on the outer surface of the outer wall 4 and of the connection sections 7, 7' as well as a section of the outer surface of each of the side walls 1, 2. The insulation film 8 reduces diffusion through the spacer. Thus, the entry of moisture into the interpane space of an insulating glazing unit or the loss of the inert gas filling of the interpane space can be reduced. Moreover, the insulation film 8 improves the thermal properties of the spacer, thus reduces thermal conductivity.

The insulation film 8 comprises the following layer sequence: a polymeric carrier film (made of LLDPE (linear low density polyethylene), thickness: 24 μm)/a metallic layer (made of aluminum, thickness: 50 nm)/a polymeric layer (PET, 12 μm)/a metallic layer (Al, 50 nm)/a polymeric layer (PET, 12 82 m). The layer stack on the carrier film thus includes two polymeric layers and two metallic layers, with the polymeric layers and the metallic layers arranged alternatingly. The layer stack can also include other metallic layers and/or polymeric layers, with metallic and polymeric layers likewise preferably arranged alternatingly such that a polymeric layer is arranged between two adjacent metallic layers in each case and a polymeric layer is arranged above the uppermost metallic layer.

By means of the assembly comprising a polymeric main body I, the reinforcing strips 6, 6', and the insulation film 8, the spacer according to the invention has advantageous properties with regard to stiffness, leakproofness, and thermal conductivity. Consequently, it is especially suitable for use in insulating glazings, in particular in the window or facade region of buildings.

FIG. 2 depicts a cross-section through an insulating glazing according to the invention in the region of the spacer. The insulating glazing is made of two glass panes 10, 11 of soda lime glass with a thickness of, for example, 3 mm, which are connected to each other via a spacer according to the invention arranged in the edge region. The spacer is the spacer of FIG. 1 with the reinforcing strips 6,6' and the insulation film 8.

The side walls 1, 2 of the spacer are bonded to the glass panes 10, 11 via, in each case, a sealing layer 13. The sealing layer 13 is made, for example, of butyl. In the edge space of the insulating glazing between the glass panes 10, 11 and the spacer, an outer sealing compound 9 is arranged peripherally. The sealing compound 9 is, for example, a silicone rubber.

The hollow chamber 5 of the main body I is preferably filled with a desiccant 12. The desiccant 12 is, for example, a molecular sieve. The desiccant 12 absorbs residual moisture present between the glass panes and the spacer and thus prevents fogging of the panes 10, 11 in the interpane space. The action of the desiccant 12 is promoted by holes (not shown) in the inner wall 3 of the main body I.

FIG. 3 depicts a flowchart of an exemplary embodiment of the method according to the invention for producing a spacer for an insulating glazings.

FIG. 4 shows a microscopic photograph of the foamed hollow profile. The polymer styrene acrylonitrile (SAN) is seen. The dark-colored hollow spaces are clearly visible. The walls between the individual cells, the hollow spaces, are completely closed. The hollow spaces are obtained by chemical foaming. A blowing agent is added to the plastic granulate, usually in the form of a so-called masterbatch granulate. By addition of heat, a volatile component of the blowing agent separates out, resulting in the foaming of the molten material.

COMPARATIVE EXAMPLE

Method for producing a foamed spacer

A mixture of:

98.5 wt.-% styrene acrylonitrile (SAN) with 35 wt.-% glass fibers (A. Schulmann) and 1.5 wt.-% color masterbatch Sicoversal® Black (BASF)

was added as granulate into an extruder and melted in the extruder at a temperature of 218° C. Using a melt pump, the molten material was shaped by a mold into a hollow profile (spacer). The still soft hollow profile with a temperature of roughly 170° C. was stabilized in a vacuum calibrator. This ensured the geometry of the hollow profile. Thereafter, the hollow profile was guided through a cooling bath and finally reached room temperature.

The hollow profile had a wall thickness of 1.0 mm±0.1 mm.

The total width of the hollow profile was 15.5 mm±0.1 mm.

The total height of the hollow profile was 6.5 mm−0.05 mm+0.25.

The weight of the hollow profile was 52 g/m.

The mechanical strength of the hollow profile was>600 N/cm.

EXAMPLE

Method for producing a foamed spacer

A mixture of:

97.7 wt.-% styrene acrylonitrile (SAN) with 35 wt.-% glass fibers (A. Schulmann)

1.5 wt.-% color masterbatch Sicoversal® Black (BASE), and 0.8 wt.-% foaming agent Polybatch 8850 E (A. Schulmann)

was added as granulate into an extruder and melted in the extruder at a temperature of 218° C. At this time, the decomposition of the foaming agent with release of $CO_2$ occurred. Using a melt pump, the molten material was shaped by a mold into a hollow profile (spacer). The still soft hollow profile with a temperature of roughly 170° C. was stabilized in a vacuum calibrator. This ensured the geometry of the hollow profile. Thereafter, the hollow profile was guided through a cooling bath and finally reached room temperature.

The hollow profile had a wall thickness of 1.0 mm±0.1 mm.

The total width of the hollow profile was 15.5 mm±0.1 mm.

The total height of the hollow profile was 6.5 mm−0.05 mm+0.25.

The weight of the hollow profile was 45 g/m.

The mechanical strength of the hollow profile is>600 N/cm.

A comparison between the non-foamed hollow profile of Comparative Example 1 and the foamed hollow profile according to the invention of Example 1 is found in Table 1.

TABLE 1

| | Comparative Example 1 | Example 1 |
|---|---|---|
| Wall thickness of the hollow profile | 1.0 mm ± 0.1 mm | 1.0 mm ± 0.1 mm |
| Width of the hollow profile | 15.5 mm ± 0.1 m | 15.5 mm ± 0.1 mm |
| Height of the hollow profile | 6.5 mm − 0.05 mm + 0.25 | 6.5 mm − 0.05 mm + 0.25 |
| Mechanical strength | >600 N/cm | >600 N/cm |
| Weight of the hollow profile | 52 g/m | 45 g/m |

With the hollow profile according to the invention, a material savings of 7 grams per meter was achieved with the same mechanical strength. This means a material savings of 13.46% based on 52 grams per meter.

A further comparison between the non-foamed hollow profile of Comparative Example 1 and the foamed hollow profile according to the invention of Example 1 is found in Table 2. For this, 12 specimens each of non-foamed and foamed hollow profiles were measured. Force/strain measurements were performed. For this, the maximum force $F_{max}$ (N) was applied to the specimen until the specimen breaks. Difference length, DL (mm) at $F_{max}$ (N) is the path that two test jaws must travel at maximum force before the hollow body breaks. In the table, X represents the mean; S, the scattering; and V, the standard deviation.

TABLE 2

| | Un-Foamed Hollow Profile | | Foamed Hollow Profile | |
|---|---|---|---|---|
| Series N = 12 | $F_{max}$ (N) | DL (mm) at $F_{max}$ (N) | $F_{max}$ (N) | DL (mm) at $F_{max}$ (N) |
| X | 1150 | 0.4 | 2290 | 0.7 |
| S | 141 | 0.1 | 730 | 0.2 |

From the comparison of the measured $F_{max}$ (N) value of the un-foamed hollow profile of 1150 N with that of the foamed hollow profile at 2290 N, it is clear that the foamed hollow profile according to the invention has substantially higher stress and fracture resistance, The comparison between the measured DL at $F_{max}$ (N) value of the un-foamed hollow profile at 0.4 mm with that of the foamed hollow profile at 0.7 mm shows that the foamed hollow profile has substantially higher elasticity.

The advantages of the foamed hollow profile according to the invention were unexpected and very surprising.

For the thermal properties of the hollow profile, an improvement of up to 45% was measured. The thermal properties are greatly improved by the gas entrapped in the hollow spaces. The in active gas entrapped in the hollow spaces acts as a very good insulator.

LIST OF REFERENCE CHARACTERS (I) polymeric main body
(1) side wall
(2) side wall
(3) inner wall
(4) outer wall
(5) hollow chamber
(6,6') reinforcing strip
(7,7') connecting section
(8) insulation film
(9) outer sealing compound
(10) glass pane
(11) glass pane
(12) desiccant
(13) sealing layer
α angle between side wall 1,2 and connecting section 7,7'

The invention claimed is:

1. A spacer for an insulating glazing unit, the spacer comprising:

a polymeric main body comprising two parallel side walls that are connected to one another by an inner wall and an outer wall, wherein the two parallel side walls, the inner wall, and the outer wall surround a hollow chamber, a thickness of the inner wall, the outer wall and the two parallel side walls is the same, the polymeric main body has a glass fiber content of 0 wt.-% to 40 wt.-%, the polymeric main body comprises hollow spaces obtained by addition of at least one foaming agent to the polymeric main body, the hollow spaces provide a weight reduction of 10 wt.-% to 20 wt.-% of the main body, and an amount of the foaming agent added is 0.5 wt.-% to 1.5 wt.-%.

2. The spacer according to claim 1, wherein the weight reduction is from 11 wt.-% to 14 wt.-%.

3. The spacer according to claim 1, wherein the amount of the foaming agent added is 0.7 wt.-% to 1.0 wt.-%.

4. The spacer according to one of claim 1, wherein the polymeric main body contains 1.0 wt.-% to 4.0 wt.-% color masterbatch.

5. The spacer according to claim 4, wherein the polymeric main body contains 1.3 wt.-% to 2.0 wt.-% color masterbatch.

6. The spacer according to claim 1, wherein the polymeric main body is fracture-resistant up to an applied force of 1800 N to 2500 N.

7. The spacer according to claim 1, wherein the polymeric main body contains one or more of polyethylene (PE), polycarbonates (PC), polystyrene, polybutadiene, polynitriles, polyesters, polyurethanes, polymethylmethacrylates, polyacrylates, polyamides, polyethylene terephthalate (PET), polybutylene terephthalate (PBT), or copolymers, derivatives and mixtures thereof.

8. The spacer according to claim 1, wherein the polymeric main body contains one or more of polypropylene (PP), acrylonitrile butadiene styrene (ABS), acrylonitrile styrene acrylester (ASA), acrylonitrile butadiene styrene/polycarbonate (ABS/PC), styrene acrylonitrile (SAN), polyethylene terephthalate/polycarbonate (PET/PC), polybutylene terephthalate/polycarbonate (PBT/PC), or copolymers, derivatives and mixtures thereof.

9. The spacer according to claim 1, wherein the polymeric main body contains one or more of styrene acrylonitrile (SAN), polypropylene (PP), or copolymers, derivatives and mixtures thereof.

10. The spacer according to claim 1, wherein embedded in each side wall of the two parallel side walls is a reinforcing strip that contains at least a metal or a metallic alloy, and has a thickness of 0.05 mm to 1 mm, and a width of 1 mm to 5 mm.

11. The spacer according to claim 10, wherein the metal or metallic alloy comprises steel.

12. The spacer according to claim 1, wherein:

the outer wall comprises an insulation film, the insulation film comprises a polymeric carrier film and at least one metallic or ceramic layer, a thickness of the polymeric carrier film is from 10 μm to 100 μm, a thickness of the metallic or ceramic layer is from 10 nm to 1500 nm, the insulation film contains at least one more polymeric layer with a thickness of 5 μm to 100 μm, the metallic or ceramic layer contains one or more of iron, aluminum, silver, copper, gold, chromium, silicon oxide, silicon nitride, or alloys, mixtures and oxides thereof, and the polymeric carrier film contains one or more of polyethylene terephthalate, ethylene vinyl alcohol, polyvinylidene chloride, polyamides, polyethylene, polypropylene, silicones, acrylonitriles, polymethyl acrylates, or copolymers and mixtures thereof.

13. A method for producing a spacer for an insulating glazing unit, the spacer comprising a polymeric main body comprising two parallel side walls that are connected to one another by an inner wall and an outer wall, wherein the two parallel side walls, the inner wall, and the outer wall surround a hollow chamber, a thickness of the inner wall, the outer wall and the two parallel side walls is the same, the polymeric main body has a glass fiber content of 0 wt.-% to 40 wt.-%, the polymeric main body comprises hollow spaces obtained by addition of at least one foaming agent to the polymeric main body, the hollow spaces provide a weight reduction of 10 wt.-% to 20 wt.-% of the main body, and an amount of the foaming agent added is 0.5 wt.-% to 1.5 wt.-%, the method comprising:

preparing a mixture of at least one polymer, color masterbatch, and a foaming agent;

melting the mixture in an extruder at a temperature of 170° C. to 230° C.;

based on the melting, decomposing the foaming agent and foaming molten material with a gas;

pressing the molten material by a mold, thereby obtaining the polymeric main body, stabilizing the polymeric main body; and cooling the polymeric main body.

14. The method according to claim 13, wherein the preparing of the mixture comprises preparing a granulate mixture at least containing:

95.0 wt.-% to 99.0 wt.-% polymer with 30.0 wt.-% to 40.0 wt.-% glass fibers, 1.0 wt.-% to 4.0 wt.-% color masterbatch, and 0.5 wt.-% to 1.5 wt.-% foaming agent.

15. The method according to claim 13, wherein the melting of the mixture comprises melting in the extruder at a temperature of 215° C. to 220° C.

16. The method according to claim 13, wherein the gas foaming the molten material comprises $CO_2$.

17. A method, comprising using of the spacer according to claim 1 in multiple glazing units.

18. The method according to claim 17, wherein the multiple glazing units comprise insulating glazing units.

19. The method according to claim 18, wherein the insulating glazing units comprise window glazing units or façade glazing units of buildings.

* * * * *